US012312137B1

(12) United States Patent
Wallace

(10) Patent No.: US 12,312,137 B1
(45) Date of Patent: May 27, 2025

(54) METHOD AND APPARATUS FOR COVERING A CORKED CONTAINER

(71) Applicant: William Chase Wallace, Johnstown, CO (US)

(72) Inventor: William Chase Wallace, Johnstown, CO (US)

( * ) Notice: Subject to any disclaimer, the term of this patent is extended or adjusted under 35 U.S.C. 154(b) by 0 days.

(21) Appl. No.: 18/898,379

(22) Filed: Sep. 26, 2024

Related U.S. Application Data

(60) Provisional application No. 63/540,463, filed on Sep. 26, 2023.

(51) Int. Cl.
*B65D 51/18* (2006.01)
*B65D 41/22* (2006.01)
*B65D 39/00* (2006.01)

(52) U.S. Cl.
CPC ..... *B65D 51/18* (2013.01); *B65D 41/225* (2013.01); *B65D 39/0011* (2013.01)

(58) Field of Classification Search
CPC ..... B65D 51/28; B65D 51/20; B65D 51/18; B65D 41/225; B65D 41/22; B65D 39/0011; B65D 39/0005; B65D 39/0058; B65D 39/00
USPC ..... 220/212.5, 200, 377, 256.1; 215/227, 215/270, 316, 364, 355
See application file for complete search history.

(56) References Cited

U.S. PATENT DOCUMENTS 2,172,544 A * 9/1939 Panter ..... B65D 39/02 215/45
2,403,734 A 7/1946 Malm
2,486,364 A 10/1949 Elta
2,670,869 A 3/1954 Jean
4,812,317 A 3/1989 Taylor
5,109,997 A 5/1992 Phillips
(Continued)

FOREIGN PATENT DOCUMENTS

BE 1014481 A 11/2003
CH 703191 A2 * 11/2011 ..... B65D 39/0064
(Continued)

OTHER PUBLICATIONS

Chengu, Pour Spout Covers Translucent Liquor Pourer Covers Universal Bottle Pour Dispenser Liquor Bottle Covers Liquor Bottle Covers Bottle Cover Dust for Home Kitchen Tools Supplies (Clear, 80 Pieces), https://www.amazon.com/dp/BOB5XKM134/ , last visited Jul. 6, 2023.
(Continued)

*Primary Examiner* — Robert J Hicks
(74) *Attorney, Agent, or Firm* — Vobach IP Law, LLC

(57) ABSTRACT

In accordance with one implementation, an apparatus for retaining moisture in a cork can include: a top wall; a roundish sidewall coupled with the top wall; an open-end portion of the roundish sidewall; wherein the open-end portion of the roundish sidewall is at the opposite end of the sidewall from the top wall; wherein the top wall and the roundish sidewall forms a closed-ended tube; wherein the shape of the closed-ended tube is adapted to be coupled with as well as removed from a re-corked bottle in a reusable manner; wherein the shape of the closed-ended tube is adapted to retain moisture in a cork of the re-corked bottle by forming a seal with the re-corked bottle when disposed on the re-corked bottle.

10 Claims, 10 Drawing Sheets

(56) References Cited

U.S. PATENT DOCUMENTS

| | | | | |
|---|---|---|---|---|
| 6,223,937 | B1 * | 5/2001 | Schmidt | B65D 47/06 222/54 |
| 9,010,952 | B2 | 4/2015 | Lenahan | |
| 10,988,286 | B2 | 4/2021 | Shemesh | |
| 2007/0039916 | A1 | 2/2007 | Wollman et al. | |
| 2011/0006029 | A1 * | 1/2011 | Granger | B65D 51/18 215/316 |
| 2011/0240589 | A1 | 10/2011 | Averill | |
| 2024/0140676 | A1 * | 5/2024 | Jouan | B65D 53/02 |

FOREIGN PATENT DOCUMENTS

| | | | | |
|---|---|---|---|---|
| KR | 200496939 | Y1 | 6/2023 | |
| WO | WO-9632337 | A1 * | 10/1996 | B65D 41/0471 |

OTHER PUBLICATIONS

Vitrix Kitchenware Store, Wine Stoppers—Silicone Wine Bottle Caps—Reusable and Unbreakable Sealer Covers—Beverage Corks to Keep Wine Fresh for Days with Air-Tight Seal—Set of 5, https://www.amazon.com/Vitrix-Kitchenware-Caps-Set-Unbreakable-Covers-Silicone/dp/B07CMXYYM3/ , last visited Jul. 6, 2023.

Linden Sweden, Linden Sweden Reusable Plastic Bottle Caps, Set of 10—Save Beverages, Prevent Spillage—Dishwasher-Safe—BPA-Freel, White, https://www.amazon.com/Linden-Sweden-Reusable-Plastic-Bottle/dp/B001760E58 , last visited Jul. 6, 2023.

* cited by examiner

METHOD AND APPARATUS FOR COVERING A CORKED CONTAINER

CROSS-REFERENCES TO RELATED APPLICATIONS

This application claims the benefit of U.S. Provisional patent application No. 63/540,463 filed on Sep. 26, 2023 entitled "Method and Apparatus for Covering a Corked Container" which is hereby incorporated by reference in its entirety and for all purposes.

SUMMARY

In accordance with one implementation, a method can be implemented that includes applying a reusable cap to a re-corked bottle; extending the reusable cap over the cork and along the neck of the re-corked bottle; forming a seal with a roundish sidewall of the reusable cap against the neck of the re-corked bottle; trapping moist air against an exposed surface of the cork in the re-corked bottle.

In accordance with another implementation, an apparatus can be implemented that includes a top wall; a roundish sidewall coupled with the top wall; an open-end portion of the roundish sidewall; wherein the open-end portion of the roundish sidewall is at the opposite end of the sidewall from the top wall; wherein the top wall and the roundish sidewall forms a closed-ended tube; wherein the shape of the closed-ended tube is adapted to be coupled with as well as removed from a re-corked bottle in a reusable manner; wherein the shape of the closed-ended tube is adapted to retain moisture in a cork of the re-corked bottle by forming a seal with the re-corked bottle when disposed on the re-corked bottle.

This Summary is provided to introduce a selection of concepts in a simplified form that are further described below in the Detailed Description. This Summary is not intended to specify key or essential features of the claimed subject matter nor is it intended to be used to limit the scope of the claimed subject matter. Other features, details, utilities, and aspects of the claimed subject matter will be apparent from the following more particular written Detailed Description of various implementations and implementations as illustrated in the accompanying drawings and recited in the appended claims.

DETAILED DESCRIPTION

Corks are effective devices to use to close off the top of a container, such as a bottle. However, corks do have drawbacks. For example, a cork can dry out and become brittle. Portions of a dried-out cork can more easily break off and drop into the contents of the bottle.

A cork that dries out can also become less effective at preventing leakage into or out of the bottle. For example, if a corked or re-corked bottle contains alcohol, the vapor from the alcohol can more easily flow past a dried-out cork and escape from the bottle. This would cause depletion of the volume of the alcohol contained in the bottle, for example. This can be particularly distressing to an owner of a bottle of expensive spirits, such as an expensive bottle of whiskey, or an old bottle of fine wine.

Some types of liquids stored in bottles are only used rarely. Thus, they can spend a long time in storage after being opened and re-corked—or even in their unopened form after the original corking. This is often the case with an expensive bottle of whiskey, for example, that is used on special occasions but not completely consumed. So, the remainder is stored for a future use. Whiskey is often stored on a shelf in an upright position—particularly when it is on-display in a bar or at a restaurant. So, it is particularly susceptible to the cork drying out.

Figure 1:
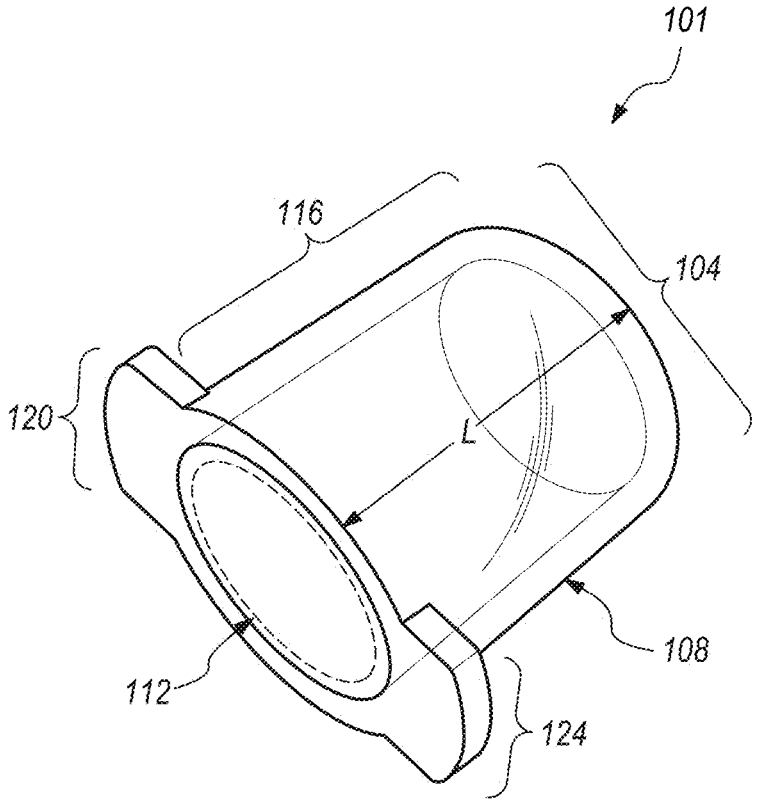
FIG. 1 illustrates a perspective view of a cap for a corked bottle, in accordance with one implementation.

To address one or more of these issues, measures can be taken to protect the integrity of a cork used with a bottle. FIG. 1 illustrates one implementation of a device that can be used to protect the integrity of a cork. In FIG. 1, a cap 101 is shown. The cap of FIG. 1 is shown having a top wall 104. A roundish sidewall 108 is coupled with the top wall. An open-end portion 112 formed by the roundish sidewall is shown in FIG. 1 by dashed line. The dashed line is for illustrative purposes. The opening formed by the roundish sidewall extends to the interior surface of the roundish sidewall. The open-end portion formed by the roundish sidewall is at the opposite end of the sidewall from the top wall. The top wall and the roundish sidewall form a closed-ended tube 116 (one end of the tube is closed and one end is open), as shown in FIG. 1. The shape of the closed-ended tube is adapted to be coupled with as well as removed from a re-corked bottle in a reusable manner. Moreover, the shape of the closed-ended tube is adapted to retain moisture in a cork of a re-corked bottle (or an originally corked and unopened corked bottle) by forming a seal with the re-corked bottle when disposed on the re-corked bottle. This implementation also shows tabs that function as handles that are formed on the cap proximate to the open-end portion-namely, a first handle 120 and a second handle 124 are shown.

In accordance with some implementations described herein the seal created by the cap and cork/bottle can be substantially airtight. For example, the cap could be configured to create a substantially airtight seal such that a person of ordinary skill in the art of wine or alcohol packaging would appreciate that the seal would not allow external air damage to a cork when the capped bottle is stored at 65 degrees Fahrenheit and 20% humidity for a period of ten years.

Figure 2:
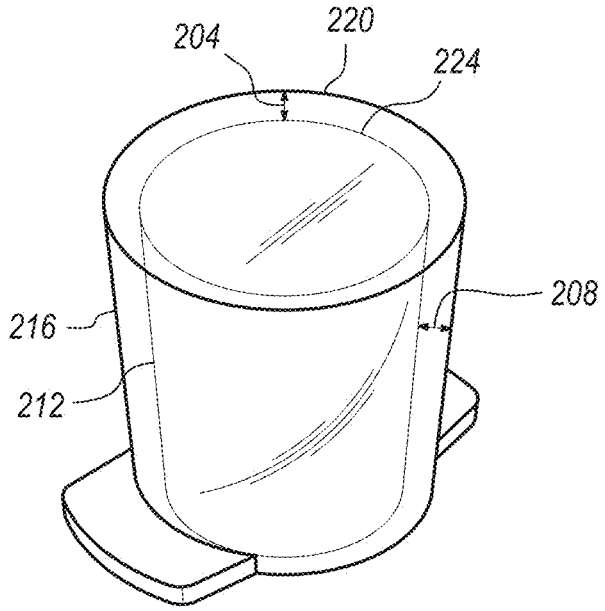
FIG. 2 illustrates a second perspective view of a cap for a corked bottle, in accordance with one implementation.
Figure 3:
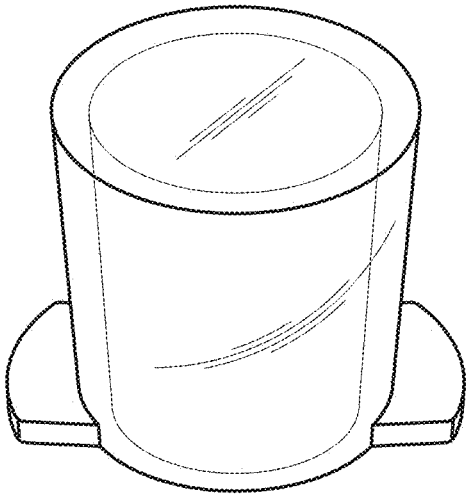
FIG. 3 illustrates a third perspective view of a cap for a corked bottle, in accordance with one implementation.
Figure 4:
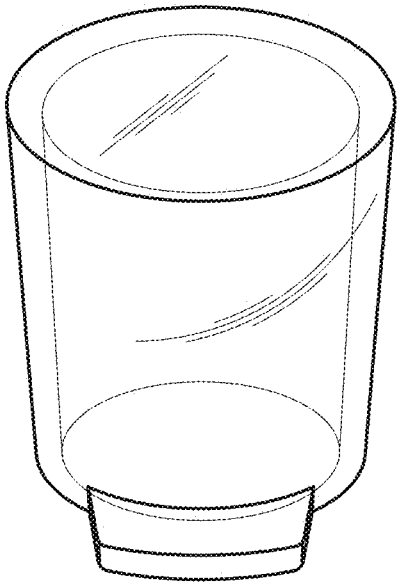
FIG. 4 illustrates a fourth perspective view of a cap for a corked bottle, in accordance with one implementation.

FIGS. 2, 3, and 4 show additional perspective views of the cap shown in FIG. 1. These figures further illustrate the positioning of the handles. It should be appreciated that handles are not necessarily required in all implementations and thus might not be used in some implementations. Alternatively, the handles could be extended around the entire circumference of the cap in order to form a continuous rim in place of the handles. In a preferred implementation, the handles or rim have sufficient width to allow fingers of an average human to grasp them and pull the cap.

As noted with respect to FIG. 1, the closed-ended tube of the cap is formed by a roundish sidewall and a top wall. These walls and the rest of the cap can be 3-D printed as one continuous article of manufacture. FIG. 2 further illustrates that the top wall can have a thickness 204. Similarly, the roundish sidewall can have a thickness 208. The roundish sidewall has an inner or interior surface 212 and an outer or exterior surface 216. The top wall has an outer or exterior surface 220 and an inner or interior surface 224.

Figure 5:
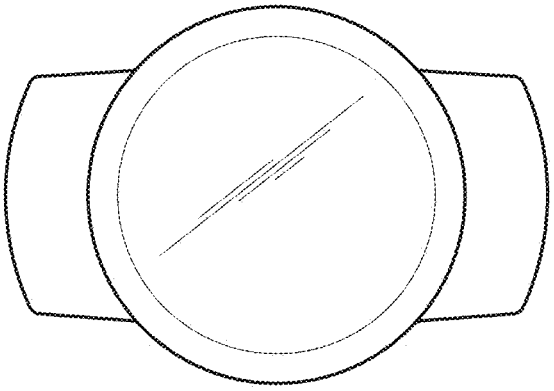
FIG. 5 illustrates top view of a cap for a corked bottle, in accordance with one implementation.

FIG. 5 shows a top view of the cap shown in FIG. 1. In this view, the top surface (or exterior surface) of the top wall is shown. This surface of the top wall is exposed to the outside environment when the cap is disposed on a corked or re-corked bottle during storage. The handles are also visible.

Figure 6:
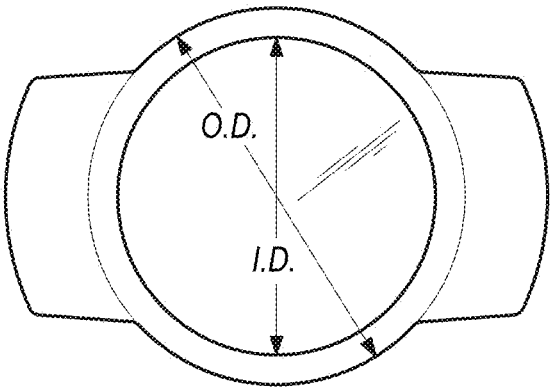
FIG. 6 illustrates a bottom view of a cap for a corked bottle, in accordance with one implementation.

FIG. 6 shows a bottom view of the cap shown in FIG. 1 looking up into the open-end portion of the roundish sidewall. The inner diameter "I.D." and outer diameter "O.D." of the roundish sidewall is also indicated. It should be appreciated that the roundish sidewall need not be perfectly round or cylindrical in a geometric sense. The roundish sidewall can form a generally cylindrical shape and is covered by the top wall.

The material used for implementations of the caps described in this disclosure can include anti-microbial material. The use of anti-microbial material will help to destroy microbes that might be present on a cork or bottle, such as molds, bacteria, and/or fungi. The contact of the anti-microbial material with the cork and/or bottle material can be used to destroy microbes that are present on the surfaces of the covered cork and/or bottle. This can be particularly advantageous if a corked or re-corked bottle is stored for a prolonged period of time. It can help prevent the bottle's contents from being compromised by the growth of microbes on the bottle surface or cork surface. If microbes are present when the contents of the bottle are poured, the poured contents could be contaminated by untreated microbes.

If anti-microbial material is used for a cap, it need not be used for the entire cap. Rather, the most desirable places to use anti-microbial material would be on one or more surfaces of the cap that during use will contact the cork and/or the bottle, e.g., the glass of a glass bottle.

The material used for implementations of the caps described in this disclosure can also be made of semi-transparent material. The semi-transparent material can be useful to reveal the advertising on a cork or bottle during use of the cap. For example, some beverage makers use advertising on their corks—a semi-transparent cap would allow a consumer to still recognize the advertising while protecting the cork at the same time. Moreover, if mold or other undesirable growth is occurring between the cork and the cap during use, the semi-transparent material would allow a person to see it and take steps to remedy the situation—for example by removing the cap and removing the growth before re-covering the bottle.

The material used for some implementations of the caps described in this disclosure can also be made of colored material. Using colored material allows the colored cap to be matched with advertising on the bottle. It might also be used to assist an individual to more readily identify bottles—for example, a preferred bottle for a bartender to use when dispensing drinks. Similarly, an owner of a wine collection or a restaurant owner or bar owner could color-code wine bottles based on their value. This might prevent the accidental use of an expensive bottle of wine when a less expensive bottle was intended.

Preferably, the material used for the cap is an elastic material. For example, the cap can be constructed of thermoplastic elastomer (TPE). Other suitable materials may be rubbers such as silicone, nitrile, and neoprene. And, the material used for the cap preferably has an indentation hardness that resists indentation in accordance with a Type A Shore rating. For example, a material having a Type A Shore rating of 30-50 would be useful. Even more preferably, a material having a Type A Shore rating of 35-45 would be useful. Most preferably, a material having a Type A Shore rating of about 38-42 would be useful.

Indentation hardness measures the resistance of a sample to material deformation due to a constant compression load from a sharp object. Tests for indentation hardness are primarily used in engineering and metallurgy. The tests work on the basic premise of measuring the critical dimensions of an indentation left by a specifically dimensioned and loaded indenter. Common indentation hardness scales are Rockwell, Vickers, Shore, and Brinell, amongst others. The ASTM D2240 standard recognizes twelve different durometer scales using combinations of specific spring forces and indentor configurations. These scales are properly referred to as durometer types; i.e., a durometer type is specifically designed to determine a specific scale, and the scale does not exist separately from the durometer.

Some conditions and procedures that are to be met, according to DIN ISO 7619-1 standard are:

For measuring Shore A the foot indents the material.

Material for testing needs to be in laboratory climate storage at least one hour before testing.

Measuring time is 15 s.

Force is 1 kg+0.1 kg for Shore A.

Five measurements need to be taken.

Calibration of the Durometer is one per week with elastomer blocks of different hardness.

The use of an elastic material permits a snug fit between the cap and an unopened corked bottle or an opened and re-corked bottle. A cap made of sufficiently elastic material can be pulled onto such a corked or re-corked bottle so that the top of the cap interfaces with the top of the cork. The elasticity allows the cap to flex sufficiently so that it can slide over the cork and the bottle and be pushed or pulled into close engagement with the top of the cork. Similarly, a cap made of sufficiently elastic material allows the cap to be removed from its position on such a corked or re-corked bottle. When the cap is removed from the bottle and no forces are acting upon it, the cap returns to its original shape, thus allowing it to be reusable.

The dimensions of the cap can vary depending on a selected application. For example, the opening 112 and inner surface circumference of the closed-end tube in FIG. 1 can be sized for a particular application. The size of the opening 112 is preferably sized to be slightly smaller in circumference than either the outer circumference of the cork or the outer circumference of the bottle neck (whichever is the bigger circumference of these two items). For example, if a decorative cork for a whiskey bottle has a top portion that has a larger outer circumference than the outer circumference of the bottle neck in which the cork sits, the cap could be made to be slightly smaller in inner circumference than the outer circumference of that cork. For example, slightly smaller could be 2 mm in circumference smaller. The resiliency of the cap would allow it to deform so as to be stretched into a larger circumference so that it can be pulled over the cork, even though the inner circumference of the cap when not stretched is smaller than the outer circumference of the cork.

The length "L" of the sidewall as shown in FIG. 1 is the length from the cork facing surface of the top wall to the edge of the opposing end of the sidewall. If the sidewall of a cap under consideration is not a uniform cylinder, then "L" is the longest possible straight line between such a non-uniform cylinder's top wall and opposing end. Different caps can be selected for different applications. For example, "L" might be selected to be 1.5" for a wine bottle, whereas "L" might be selected to be 4" for a unique whiskey bottle. It is believed that a length "L" of at least two inches would be useful for many applications.

Figure 7:
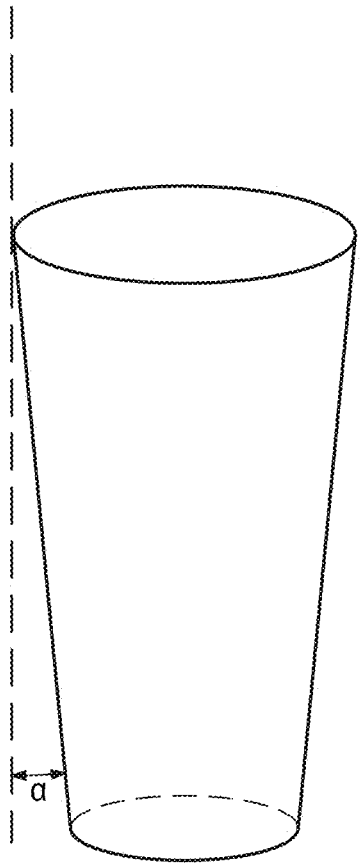
FIG. 7 illustrates a cap having a tapered roundish sidewall, in accordance with one implementation.

FIG. 7 illustrates an implementation in which the roundish sidewall is tapered from wider to narrower. In the implementation of FIG. 7, the roundish sidewall tapers from vertical at an angle alpha ($\alpha$). Stated differently, the closed end tube comprises an opening at the opposing end from the top wall and the roundish sidewall comprises a taper so that the opening formed by the roundish sidewall is smaller in circumference than the circumference of the top wall.

A cap with a narrow taper—where alpha is a positive angle—is useful for a corked or re-corked bottle in which the widest portion of the cork is wider than the width of the bottle's neck. Thus, such a cap can conform to the bottle at its narrow end and conform to the cork at its wider end. A cap made with resilient material would allow the narrow end to be pulled or pushed past the wide cork. FIG. 7 also illustrates an implementation without handles.

A cap with a wide taper—where alpha is a negative angle—is useful for a corked or re-corked bottle in which the width of the bottle neck is wider than the width of the cork. Such a cap can conform better to the neck of the bottle at the bottom of the cap while promoting close engagement between the inner surface of the cap and the cork at the top of the cap.

Figure 8:
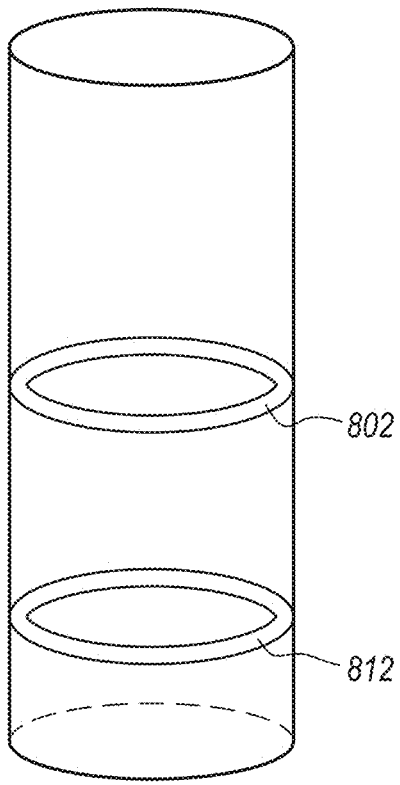
FIG. 8 illustrates a cap having two embossments on the inner surface of the cap, in accordance with one implementation.
Figure 9:
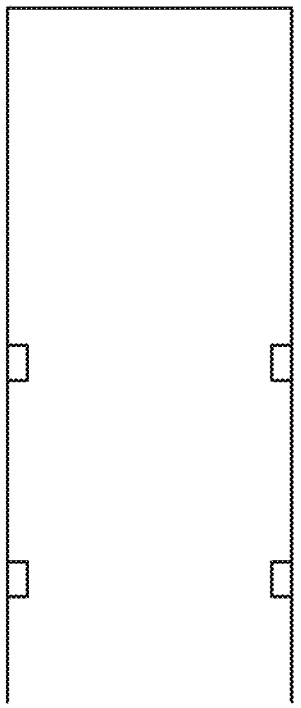
FIG. 9 illustrates a cross-section of a cap having two embossment rings, in accordance with one implementation.

FIGS. 8 and 9 illustrate an implementation of a cap that includes embossment rings on the inner surface of the cap. FIG. 8 shows a first embossment ring 812 on the inner surface of the cap. The first embossment ring has a width, as shown by the cross-section in FIG. 9 and extends all the way around the interior surface of the roundish sidewall. A second embossment ring 802 is also shown having similar dimensions. The first and/or second embossment rings can be used to create a tighter seal with the neck of the bottle. While a cap made of resilient material can be slipped over the neck of the bottle, each embossment ring will create a closer seal with the bottle neck. Thus, vapor will be impeded from escaping from the bottle, if such vapor gets past the cork. And, environmental air—including possible mold spores, bacteria, and/or fungi—will be prevented from entering the cap from the bottom and migrating toward the cork. The first embossment is shown located proximate to the opening formed by the roundish sidewall. For example, it can be located within ½ inch from the edge of the opening. Similarly, the second embossment can be located proximate the first embossment. For example, it can be located ¼ inch from the first embossment ring.

FIG. 9 is a cross-section of FIG. 8 that shows the embossments as narrower portions of the inner surface of the cap.

Figure 10:
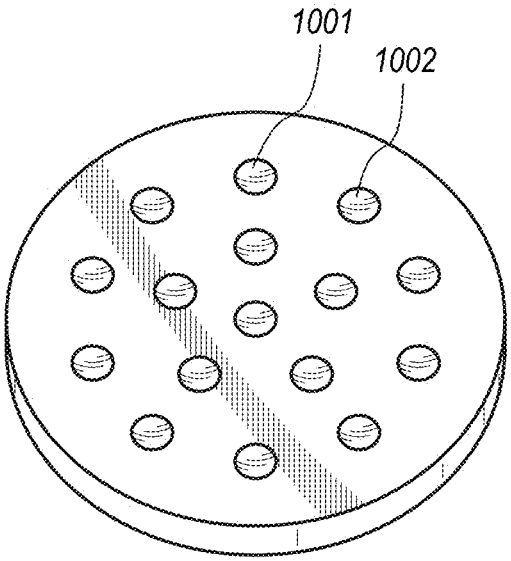
FIG. 10 illustrates a cork-facing surface of a cap having scalloped or pitted depressions, in accordance with one implementation.

In accordance with one implementation, the inner surface of a cap can be formed to promote adherence of water. For example, FIG. 10 shows an implementation of the cork facing surface of the top wall of a cap. This cork facing surface is formed with depressions—e.g., depressions 1001 and 1002. The depressions facilitate the retention of liquid, such as water, in the depressions. Thus, such a cap could be rinsed with water prior to mounting the cap on a corked or re-corked bottle. The depressions would help to retain the water. And the water would moisturize the cork when the cap is applied. Such depressions could be manufactured in a cap using a mold or 3-D printing, for example. The depressions could take the form of scalloped or curved depressions or flat-bottomed pits, for example.

Figure 11:
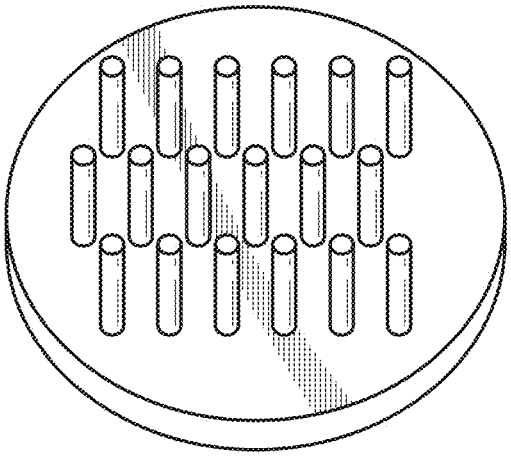
FIG. 11 illustrates a cork-facing surface of a cap having poles, in accordance with one implementation.

Similarly, FIG. 11 shows an implementation in which the inner surface of the cap can be formed with poles in proximity to one another. The poles allow liquid to adhere to or between them, thus facilitating the retention of the liquid. Thus, for example, the cap could be rinsed with water prior to mounting the cap on a corked or re-corked bottle. Again, a mold or 3-D printing could be used to manufacture the poles.

In accordance with one implementation a solid insert can be used as an insert for the top wall. The solid insert would provide more structural integrity that might be useful when the cap is coupled with a bottle by either a person or a machine. The solid insert could be overmolded with the materials described herein in order to form the finished cap. Alternatively, one might choose to overmold the cap and adhesively attach it as a top wall to a roundish sidewall to form a cap. The solid insert could also be inscribed with labeling or advertising information.

In accordance with one implementation, a cap (also sometimes referred to as a cover) can be applied to a re-corked (or corked) bottle, as follows: apply a reusable cap to a re-corked bottle; extend the reusable cap over the cork and along the neck of the re-corked bottle; form a seal with a roundish sidewall of the reusable cap against the neck of the re-corked bottle; trap moist air against an exposed surface of the cork in the re-corked bottle. The figures illustrate this in more detail.

In accordance with one implementation, production of newly corked wine bottles can include a step of covering the corked wine bottle. Caps can be turned inside out and rolled onto the tops of the respective bottles so that the corks are protected as explained herein.

Figure 12:
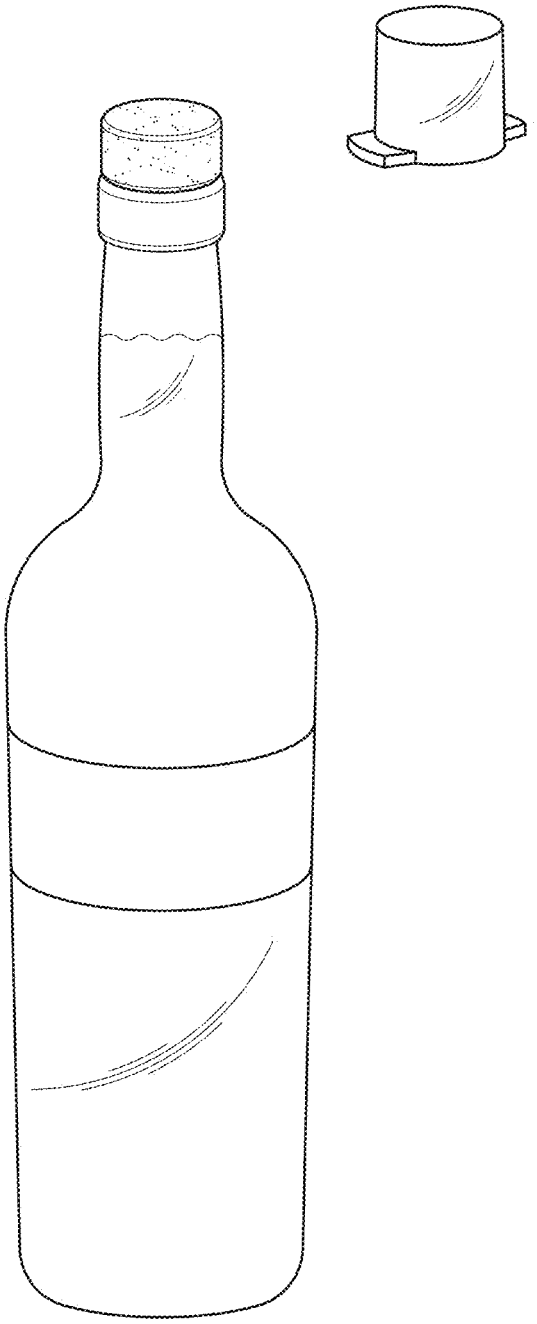
FIG. 12 illustrates an unopened bottle next to a cap for the bottle, in accordance with one implementation.

FIG. 12 illustrates an unopened bottle and a cap for covering the cork and bottle. The cap can be used with either a new unopened corked bottle or with an uncorked and then re-corked bottle.

Figure 13:
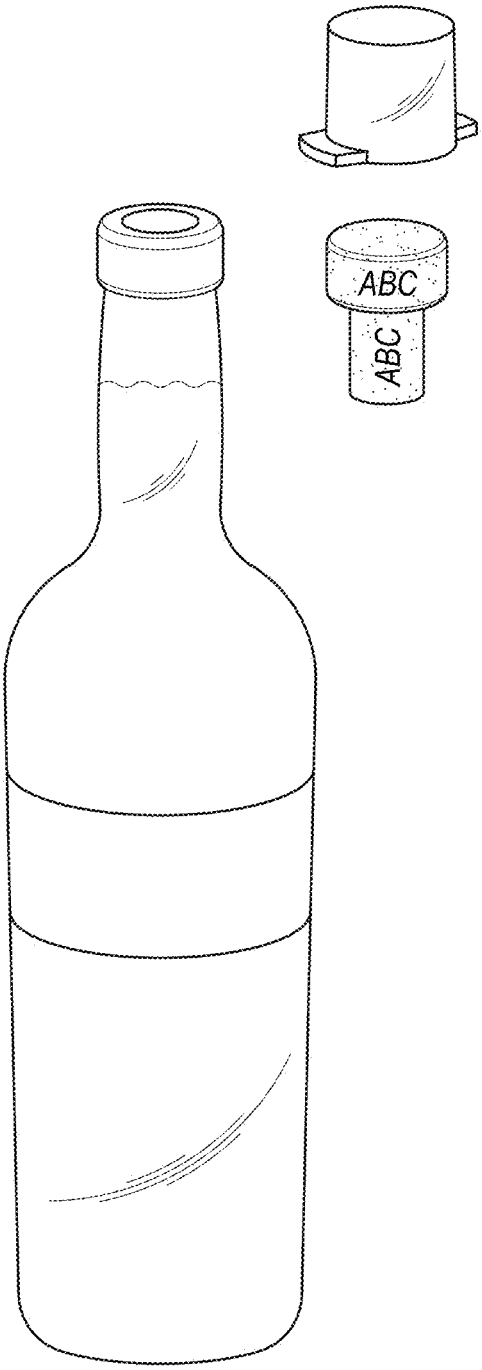
FIG. 13 illustrates a bottle with the cork removed alongside a cap for the cork and bottle, in accordance with one implementation.
Figure 14:
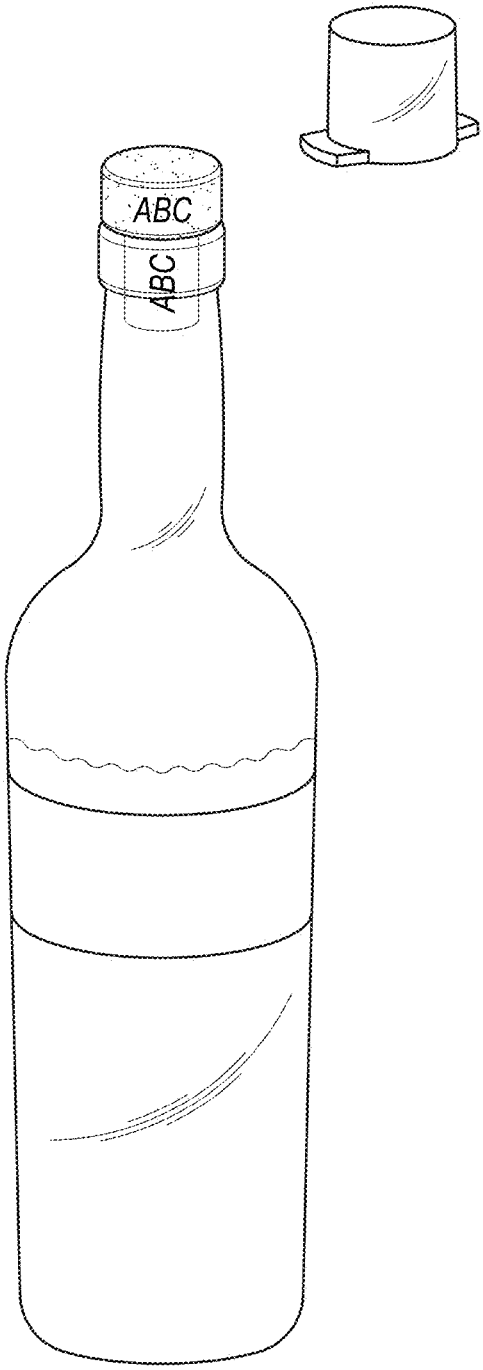
FIG. 14 illustrates an opened bottle with the cork re-inserted, in accordance with one implementation.

FIG. 13 shows the bottle with the cork removed. Notably, some bottles are produced with advertising on the cork. For an unopened bottle, the advertising on the cork, which is viewable through the glass of the bottle, helps a consumer to verify the origin and authenticity of the bottle's contents. FIG. 13 shows the removed cork as having advertising on the cork. FIG. 14 shows that the cork has been re-corked into the bottle. When transparent or translucent material is used for the cap, the advertising will still be discernible in most cases.

Figure 15:
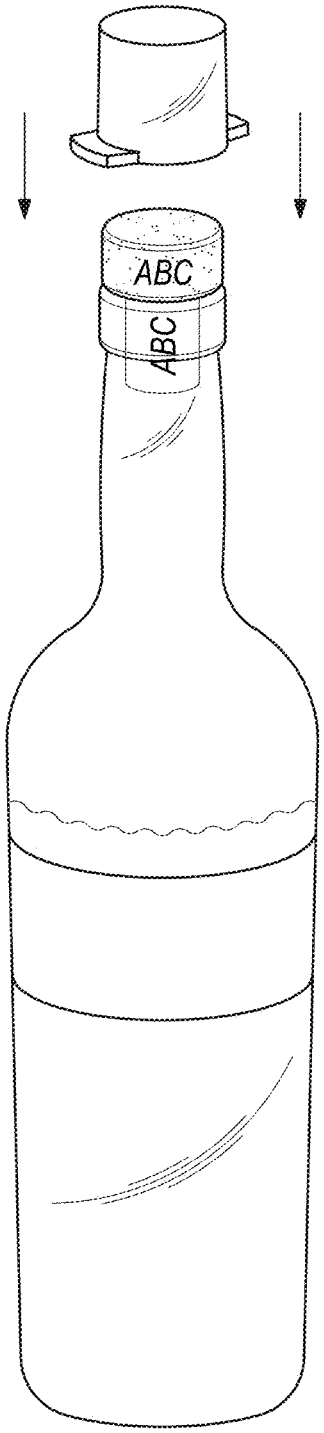
FIG. 15 illustrates placement of a cap on a re-corked bottle, in accordance with one implementation.

FIG. 15 illustrates that the cap is placed onto the cork and bottle. The arrows indicate that a user can push and/or pull the cap onto the cork and bottle neck.

Figure 16:
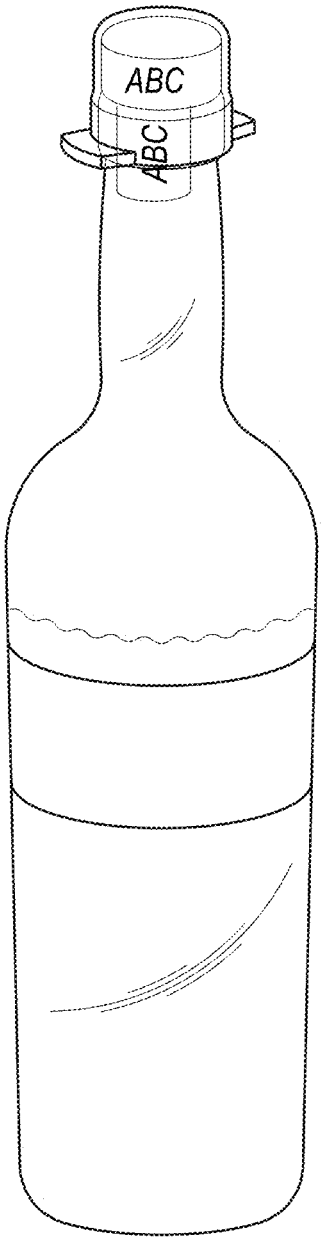
FIG. 16 illustrates a re-corked bottle with a cap placed over the cork and over a portion of the bottle, in accordance with one implementation.

FIG. 16 shows the cap fully installed on the cork and bottle. As can be seen in FIG. 16, the advertising on the cork can still be seen due to the semi-transparent material of the cap.

Figure 17:
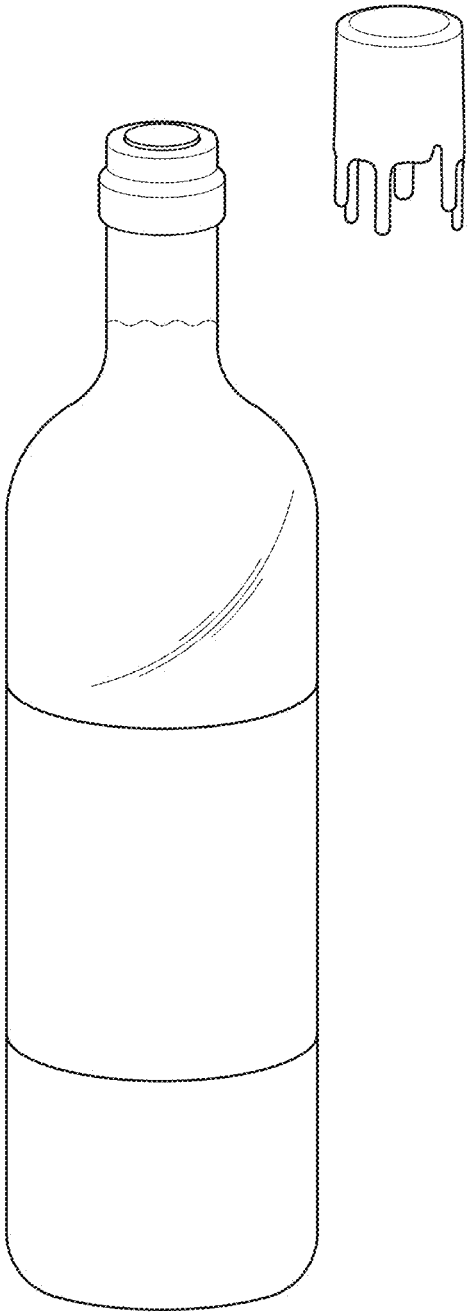
FIG. 17 illustrates a corked bottle with a faux-wax cap beside it, in accordance with one implementation.
Figure 18:
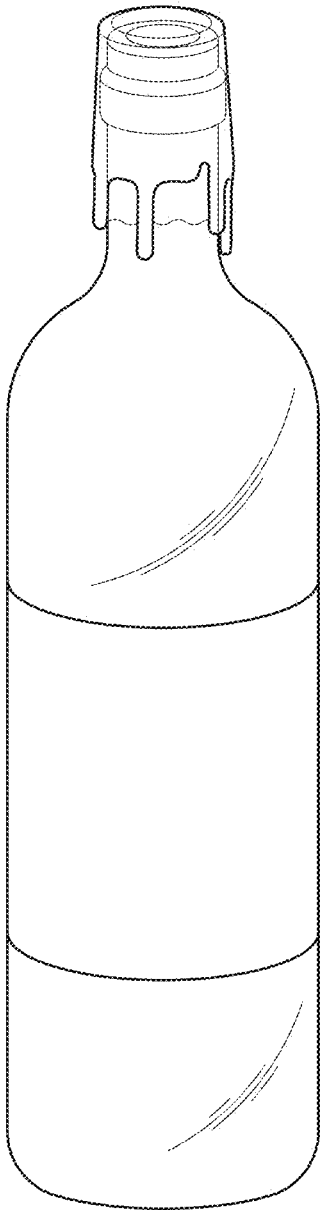
FIG. 18 illustrates a corked bottle with the faux-wax cap placed over the top of the bottle, in accordance with one implementation.

FIGS. 17 and 18 illustrate the use of a faux wax cap. A faux wax cap performs the same as the caps described herein but also has the appearance of wax to an observer. This gives the appearance that the bottle top has been dipped in wax.

As noted earlier, an installed cap permits moisture to be trapped between the cap, the bottle, and the cork. The trapped moisture can thus help to preserve the integrity of the cork, by moisturizing the cork and thus impeding the cork from drying out.

When a cap is pulled onto a re-corked bottle, the trapped air between the cap and the cork has nowhere to go due to the tight seal. This makes it difficult to apply the cap. The same effect occurs when the cap is removed from the re-corked bottle; the suction of the cap to create a tight seal makes it difficult to remove the cap. A friction between the surface of the cap and re-corked bottle also contributes to the difficulty of applying and removing the cap. When an implementation of the cap is used that has tab handles or a rim as part of the cap, a user may pull one or more of the tab handles or the rim away from the surface of the bottle-thus breaking the suction and permitting ambient air to enter via the opening. This allows the vacuum seal to be broken and the cap to be removed more easily. It also reduces the surface friction between the cap and the bottle, thus allowing the cap to be removed with less friction.

Figure 19:
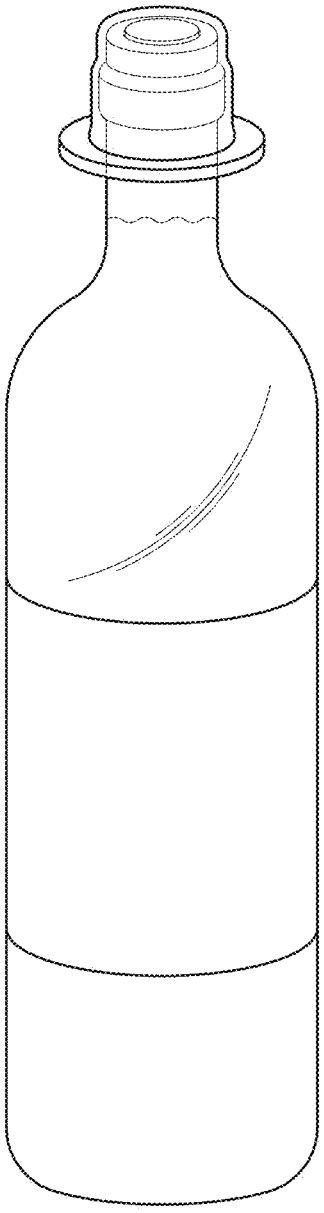
FIG. 19 illustrates an unopened corked bottle with a cap having a rim handle placed over the top of the cork, in accordance with one implementation.

FIG. 19 shows an unopened bottle with the cork yet to be removed and a cap surface flush against the cork's exposed surface. In such an implementation, mold can be prevented from building up on the cork. In the case of wine, for example, a capped wine bottle could be stored in a wine cellar unopened for an extended period of time without the problem of mold buildup. In the implementation of FIG. 19, a continuous rim handle is shown. The continuous rim extends around the circumference of the cap.

Figure 20:
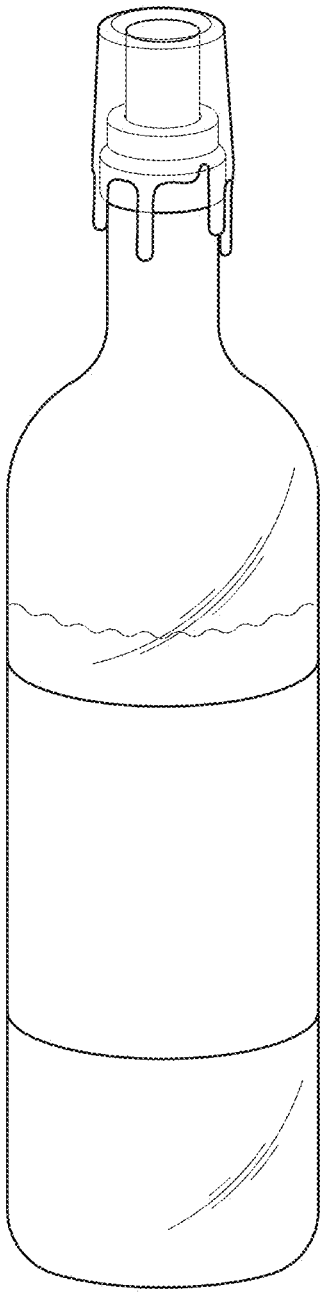
FIG. 20 illustrates a re-corked wine bottle with a cap placed over the cork and extending down the neck of a bottle, in accordance with one implementation.

FIG. 20 illustrates an implementation of a cap on an opened and re-corked bottle of wine, for example. As can be seen the cap interfaces closely with the top of the cork and has sufficient length to extend down a portion of the bottle neck. In this example, the faux wax cap is shown. However, it should be appreciated that the other implementations of caps discussed herein could also be applied to a re-corked bottle, such as a wine bottle.

In the above description, for the purposes of explanation, numerous specific details are set forth in order to provide a thorough understanding of the implementations described. It will be apparent, however, to one skilled in the art that these implementations may be practiced without some of these specific details. For example, while various features are ascribed to particular implementations, it should be appreciated that the features described with respect to one implementation may be incorporated with other implementations as well. However, no single feature or features of any described implementation should be considered essential, as other implementations may omit such features.

In the interest of clarity, not all of the routine functions of the implementations described herein are shown and described. It will, of course, be appreciated that in the development of any such actual implementation, numerous implementation-specific decisions must be made in order to achieve the developer's specific goals, such as compliance with application and business-related constraints, and that those specific goals will vary from one implementation to another and from one developer to another.

The above specification, examples, and data provide a complete description of the structure and use of exemplary implementations. Furthermore, structural features of the different implementations may be combined in yet another implementation without departing from the recited claims.

What is claimed is:

1. An apparatus for retaining moisture in a cork, comprising:

a top wall;

a roundish sidewall coupled with the top wall;

an open-end portion of the roundish sidewall;

wherein the open-end portion of the roundish sidewall is at the opposite end of the sidewall from the top wall;

wherein the top wall and the roundish sidewall forms a closed-ended tube;

wherein the shape of the closed-ended tube is adapted to be coupled with as well as removed from a re-corked bottle in a reusable manner;

wherein the shape of the closed-ended tube is adapted to retain moisture in a cork of the re-corked bottle by forming a seal with the re-corked bottle when disposed on the re-corked bottle.

2. The apparatus of claim 1 wherein the closed-ended tube comprises anti-microbial material.

3. The apparatus of claim 1 wherein the top wall comprises a cork facing surface when closed-ended tube is coupled with the re-corked bottle and wherein the cork facing surface comprises pits adapted to retain fluid.

4. The apparatus of claim 1 wherein the closed-ended tube is semi-transparent.

5. The apparatus of claim 1 and further comprising at least one handle formed on the roundish sidewall.

6. The apparatus of claim 1 wherein the closed-ended tube comprises material having a Type A Shore rating of 30-50 in accordance with ASTM D2240 and a 15 second testing time.

7. The apparatus of claim 1 wherein the roundish sidewall has a length of at least two inches.

8. The apparatus of claim 1 wherein the roundish sidewall comprises a first embossment ring proximate the open end of the roundish sidewall.

9. The apparatus of claim 8 wherein the roundish sidewall comprises a second embossment ring.

10. The apparatus of claim 1 wherein closed end tube comprises an opening at the opposing end from the top wall and wherein the roundish sidewall comprises a taper so that the opening formed by the roundish sidewall is smaller in circumference than the circumference of the top wall.

* * * * *